US009311764B2

(12) United States Patent
Chen

(10) Patent No.: US 9,311,764 B2
(45) Date of Patent: Apr. 12, 2016

(54) COIN COUNTING APPARATUS

(71) Applicant: Symotor Seiko Ltd., Kaohsiung (TW)

(72) Inventor: Tai-Hui Chen, Kaohsiung (TW)

(73) Assignee: SYMOTOR SEIKO LTD., Kaohsiung (TW)

( * ) Notice: Subject to any disclaimer, the term of this patent is extended or adjusted under 35 U.S.C. 154(b) by 0 days.

(21) Appl. No.: 14/627,744

(22) Filed: Feb. 20, 2015

(65) Prior Publication Data

US 2015/0243118 A1 Aug. 27, 2015

(30) Foreign Application Priority Data

Feb. 24, 2014 (TW) ..... 103106074 A
Sep. 17, 2014 (TW) ..... 103132112 A

(51) Int. Cl.
*G07D 9/00* (2006.01)
*G07D 1/00* (2006.01)

(52) U.S. Cl.
CPC . *G07D 9/008* (2013.01); *G07D 1/00* (2013.01)

(58) Field of Classification Search
CPC ..... G07D 9/00; G07D 9/04; G07D 9/008
USPC ..... 453/18, 29, 30, 33–35, 49–52, 57, 58
See application file for complete search history.

(56) References Cited

U.S. PATENT DOCUMENTS 5,512,016 A * 4/1996 Tani ..... G07D 9/008 453/32
6,685,552 B2 * 2/2004 Nomura ..... G07D 9/008 221/227
2005/0227604 A1 * 10/2005 Chang ..... G07D 9/008 453/18
2007/0207717 A1 * 9/2007 Enomoto ..... G07D 1/00 453/49

* cited by examiner

*Primary Examiner* — Mark Beauchaine
(74) *Attorney, Agent, or Firm* — Muncy, Geissler, Olds & Lowe, P.C.

(57) ABSTRACT

A coin counting apparatus includes a mounting unit with a base plate, and a guiding unit connected to the mounting unit. The guiding unit includes a guiding member connected to the base plate, a cover member cooperating with the base plate to define a guiding space, an adjusting plate connected to the base plate, a positioning bolt connected to a pivotable swing arm and slidable in a guidance sliding groove of the cover member and a base sliding groove of the base plate, and two fastener members fastening the adjusting plate to the base plate. The adjusting plate is movable relative to the base plate to cover a portion of the base sliding groove so that a range of the sliding movement of the positioning bolt is adjustable.

9 Claims, 14 Drawing Sheets

COIN COUNTING APPARATUS

CROSS-REFERENCE TO RELATED APPLICATIONS

This application claims priorities of Taiwanese Application No. 103106074, filed on Feb. 24, 2014, and Taiwanese Application No. 103132112, filed on Sep. 17, 2014.

FIELD

The disclosure relates to a counting apparatus, and more particularly to a coin counting apparatus.

BACKGROUND

Referring to FIGS. 1 and 2, a conventional coin counting apparatus 1 includes a mounting unit 11, a guiding unit 12 that is mounted on the mounting unit 11, a receiving member 13 that has a receiving space 131, a track member 14 that is connected to the guiding unit 12, and a counter 15 that is disposed on the track member 14.

The mounting unit 11 includes a mounting seat 111 and a base plate 112 that is disposed on the mounting seat 111 and formed with an engaging groove (not shown) extending therethrough. The guiding unit 12 includes a rotary member 121, a plurality of pusher bolts 122, a guiding member 123, a cover plate 124, a swing arm 126, a positioning bolt 127 and a spring 128. The rotary member 121 is rotatably disposed on the base plate 112 at a position corresponding to the receiving space 131 of the receiving member 13. The pusher bolts 122 extend from a front side of the base plate 112 toward the rotary member 121. The guiding member 123 is rotatably disposed on the base plate 112 and is spaced apart from the rotary member 121. The cover plate 124 is connected to the base plate 112, cooperates with the base plate 112 to define a guiding space 120 in which the rotary member 121 is partially received, and has a sliding groove 125 that is communicated with the guiding space 120 in alignment with the engaging groove of the base plate 112. The swing arm 126 is pivotally mounted on the base plate 112. The positioning bolt 127 is connected co-movably to the swing arm 126 and engages slidably the sliding groove 125 of the cover plate 124 and the engaging groove of the base plate 112. The spring 128 is disposed on a back side of the base plate 112, and has two opposite ends respectively fixed on the base plate 112 and the positioning bolt 127.

The rotary member 121 has a rotary body 1211 formed with a plurality of coin-receiving openings 1212 for receiving coins 2 from the receiving space 131 of the receiving member 13, and a plurality of limiting element sets 1213 each being disposed between a respective adjacent pair of the coin-receiving openings 1212. The guiding member 123 has a guiding body 1231 and a plurality of angularly spaced-apart guiding arms 1232 connected to the guiding body 1231.

The track member 14 has a passageway 141 in communication with the guiding space 120. The coins 2 are conveyed from the guiding unit 12 to pass through the passageway 14, and are counted by the counter 15.

During rotation of the rotary member 121 and the guiding member 123, the pusher bolts 122 and the limiting element sets 1213 cooperatively propel each of the coins 2 which are disposed between the rotary body 1211 and the base plate 112 into the guiding space 120. The guiding arms 1232 then advance the coin 2 by virtue of the rotation of the guiding member 123 to push against the positioning bolt 127. The positioning bolt 127 is thereby propelled to slide a sufficient distance along the sliding groove 125 of the cover plate 124, such that the spring 128 is driven by the positioning bolt 127 to have a restoring force that can move back the positioning bolt 127 and consequently urge the coin 2 to enter the passageway 141. If the slide distance of the positioning bolt 127 along the sliding groove 125 of the cover plate 124 is insufficient, the coin 2 will be jammed between the guiding arms 1232 and the positioning bolt 127. If the slide distance of the positioning bolt 127 is excessive in the sliding groove 125 of the cover plate 124, the guiding arms 1232 will carry the coin 2 to pass by the entrance of the passageway 141 before the spring 128 can restore to urge the coin 2. In either case, the coin 2 is unable to successfully enter the passageway 141. Therefore, the length of the sliding groove 125 has to be determined based on the size of the coins 2 in order to appropriately limit the slide movement of the positioning bolt 127. However, the conventional coin counting apparatus 1 with the fixed-length sliding groove 125 cannot count coins of different sizes.

SUMMARY

Therefore, an object of the disclosure is to provide a coin count ing apparatus that can alleviate the drawback of the prior art.

According to an object of the disclosure, the coin counting apparatus includes a mounting unit, a rotating unit, a receiving unit, a guiding unit and a track unit.

The mounting unit includes amounting seat and a base plate that is connected to the mounting seat, and that is formed with a base sliding groove extending therethrough.

The rotating unit includes a turntable member and a motor. The turntable member is rotatably connected to the base plate. The motor is for driving rotation of the turntable member.

The receiving unit is coupled to the base plate, surrounds the turntable member, and defines a receiving space that is adapted for receiving a plurality of coins.

The guiding unit includes a guiding member, a cover member, an adjusting plate, a swing arm, a positioning bolt, two fastener members and a resilient member. The guiding member is rotatably connected to the base plate, and is spaced apart from and configured to be co-rotatable with the turntable member. The cover member covers the base plate in proximity to the guiding member, cooperates with the base plate to define a guiding space, and is formed with a guidance sliding groove extending therethrough. The guidance sliding groove is registered with the base sliding groove of the base plate. The adjusting plate is connected to aside of the base plate opposite to the cover member, and is movable relative to the base plate and the cover member to adjustably cover a portion of the base sliding groove. The swing arm is swingably disposed between the base plate and the adjusting plate. The positioning bolt has opposite first and second end portions. The first end portion extends from the swing arm and extends slidably into the base sliding groove and the guidance sliding groove. The second end portion extends from the swing arm and is close to the adjusting plate. The fastener members fasten removably the adjusting plate to the base plate. The resilient member is disposed in proximity to the base plate and has two opposite ends respectively connected to the second end portion of the positioning bolt and the base plate.

The track unit is connected to the guiding unit, and includes a track member and a counter. The track member defines a passageway in communication with the guiding space. The counter is mounted on the track member.

Each of the coins is pushed via rotation of the guiding member from the rotating unit into the guiding space, and is further pushed by the guiding member to drive sliding movement of the first end portion of the positioning bolt along the base sliding groove and the guidance sliding groove, and to extend resiliently the resilient member until the second end portion of the positioning bolt abuts against the adjusting plate, thereby permitting passage of the coin into the passageway.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
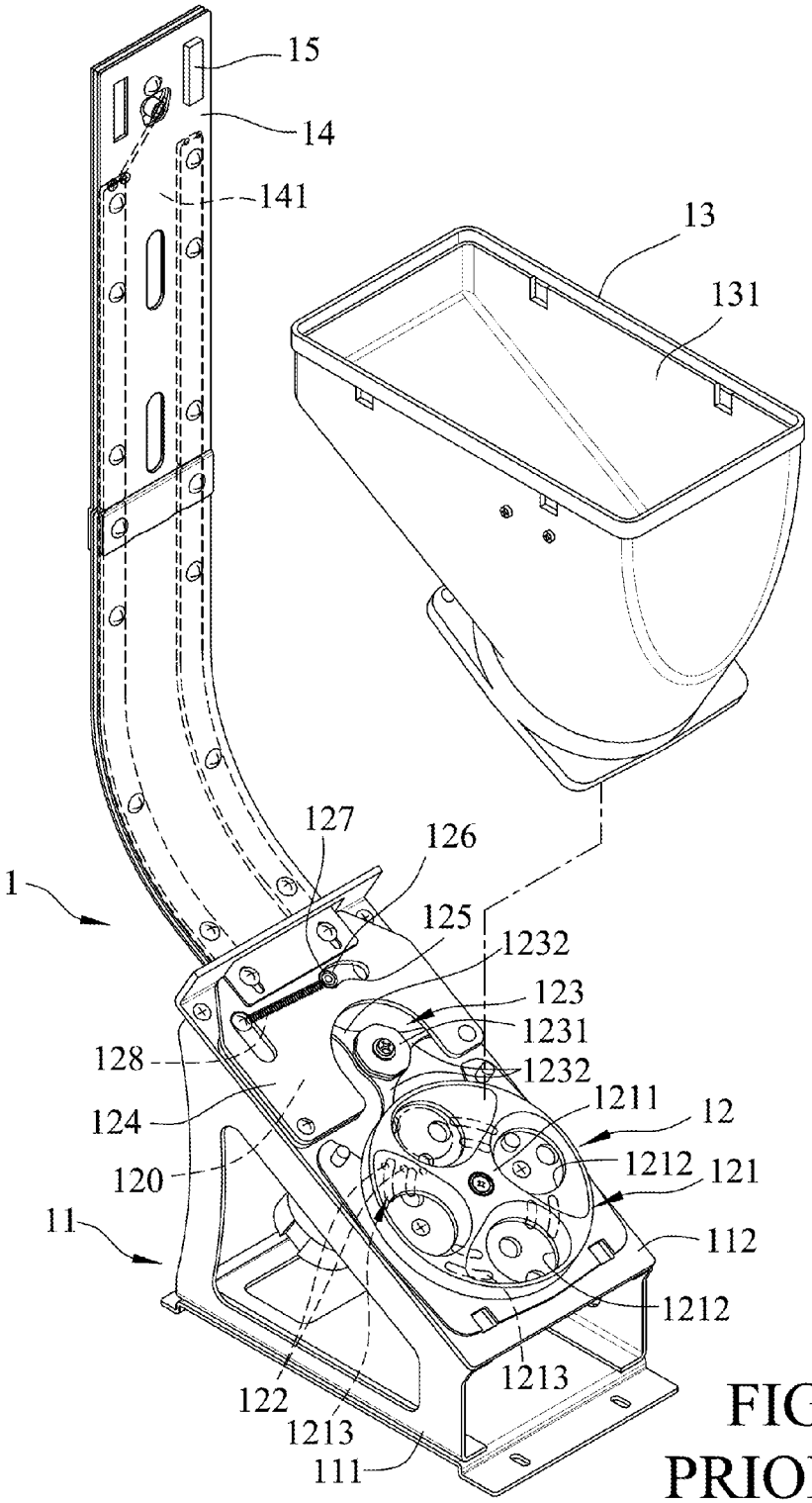
FIG.1 PRIOR ART
FIG. 1 is a partly exploded perspective view of a conventional coin counting apparatus.
Figure 2:
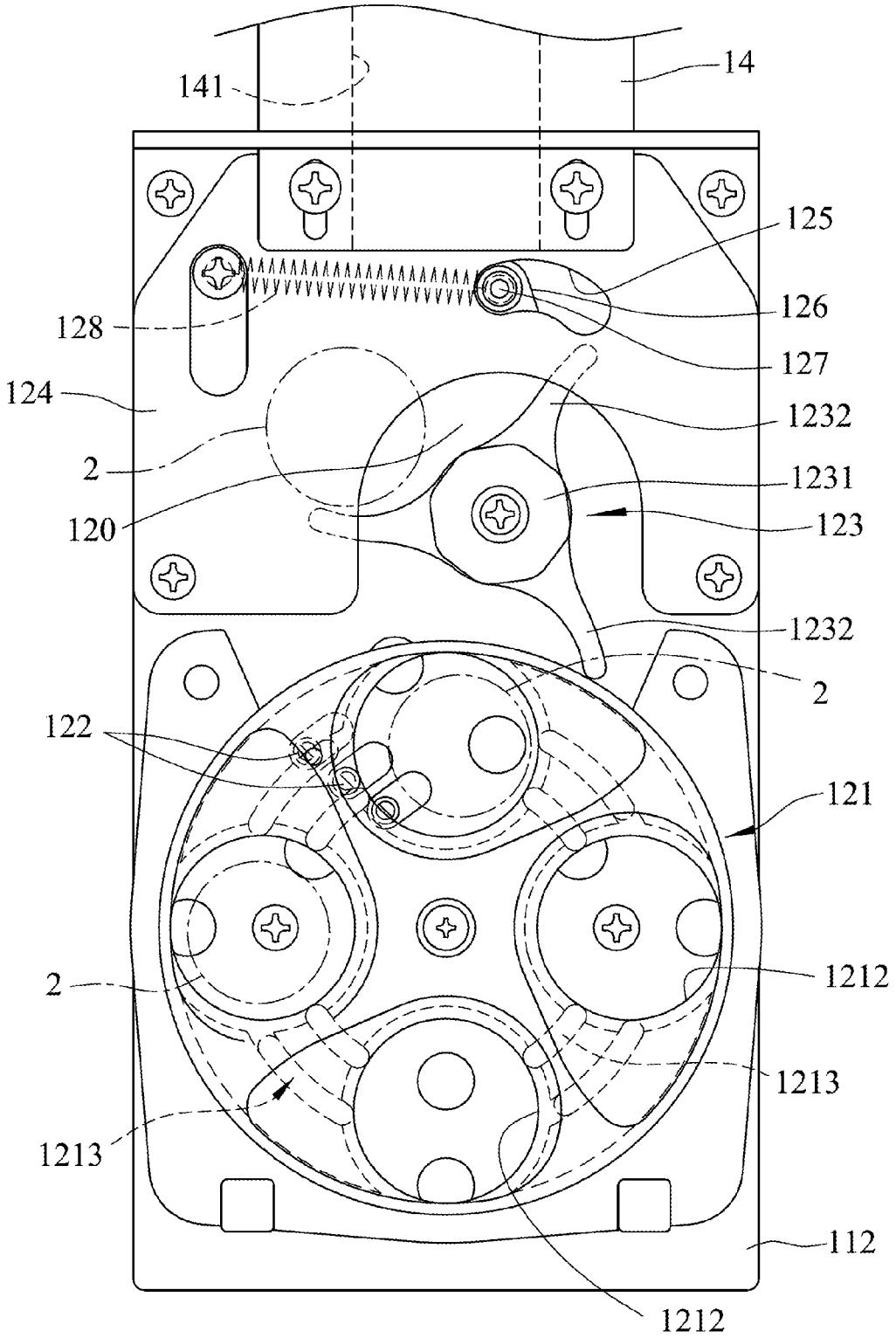
FIG.2 PRIOR ART
FIG. 2 is a fragmentary top view of the conventional coin counting apparatus.
Figure 3:
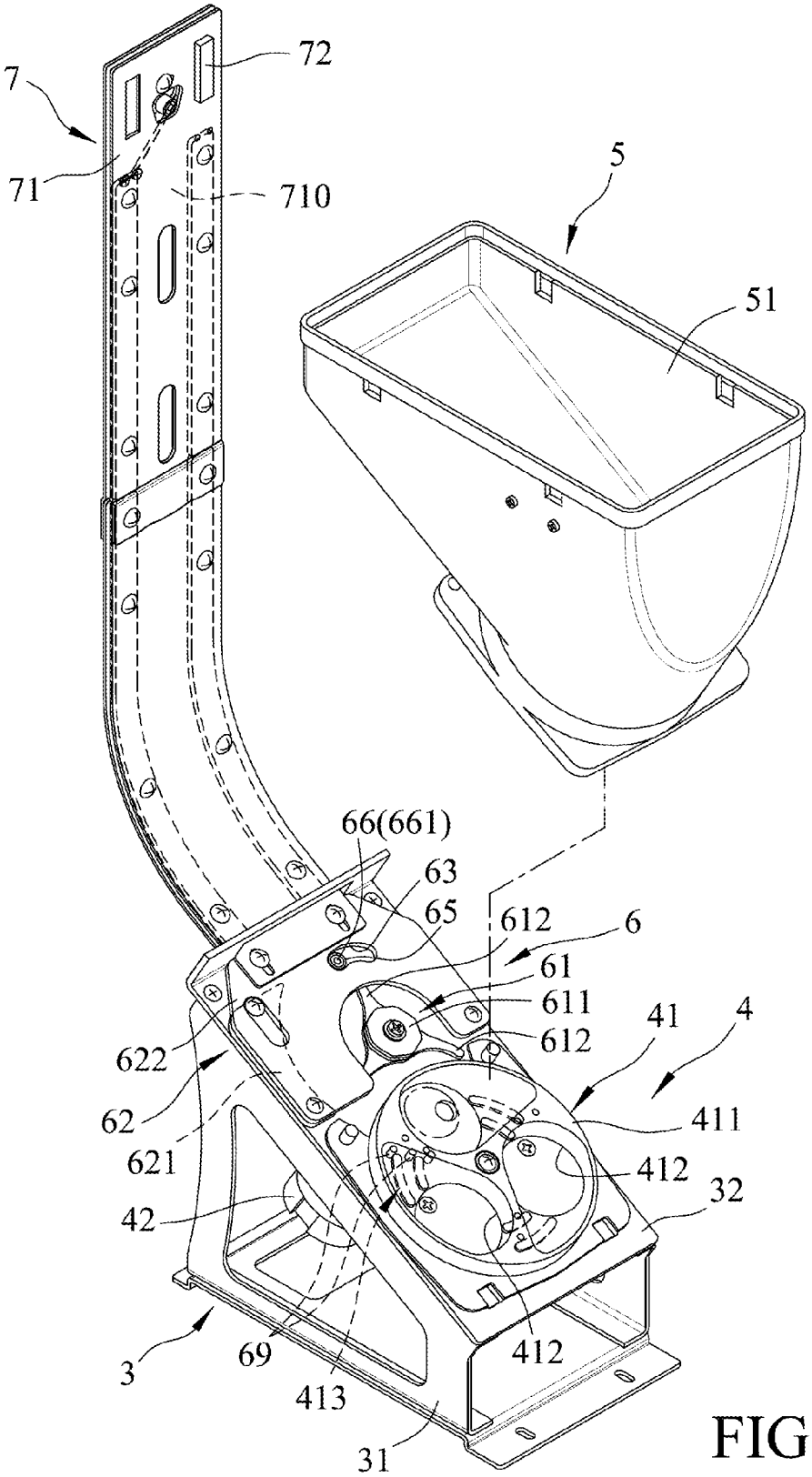
FIG. 3 is a partly exploded perspective view of an embodiment of a coin counting apparatus according to the disclosure.
Figure 4:
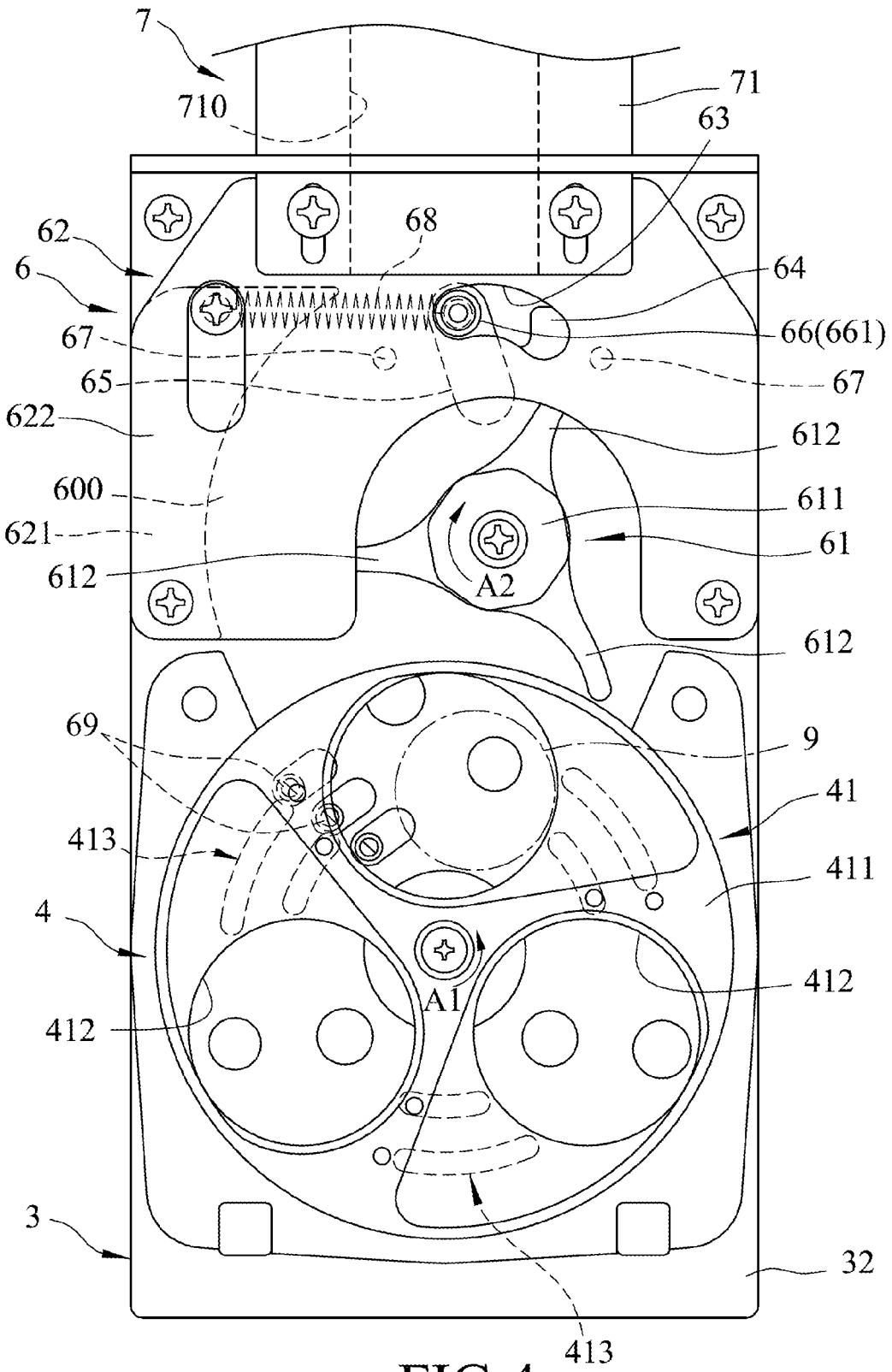
FIG. 4 is a fragmentary top view of the embodiment.
Figure 5:
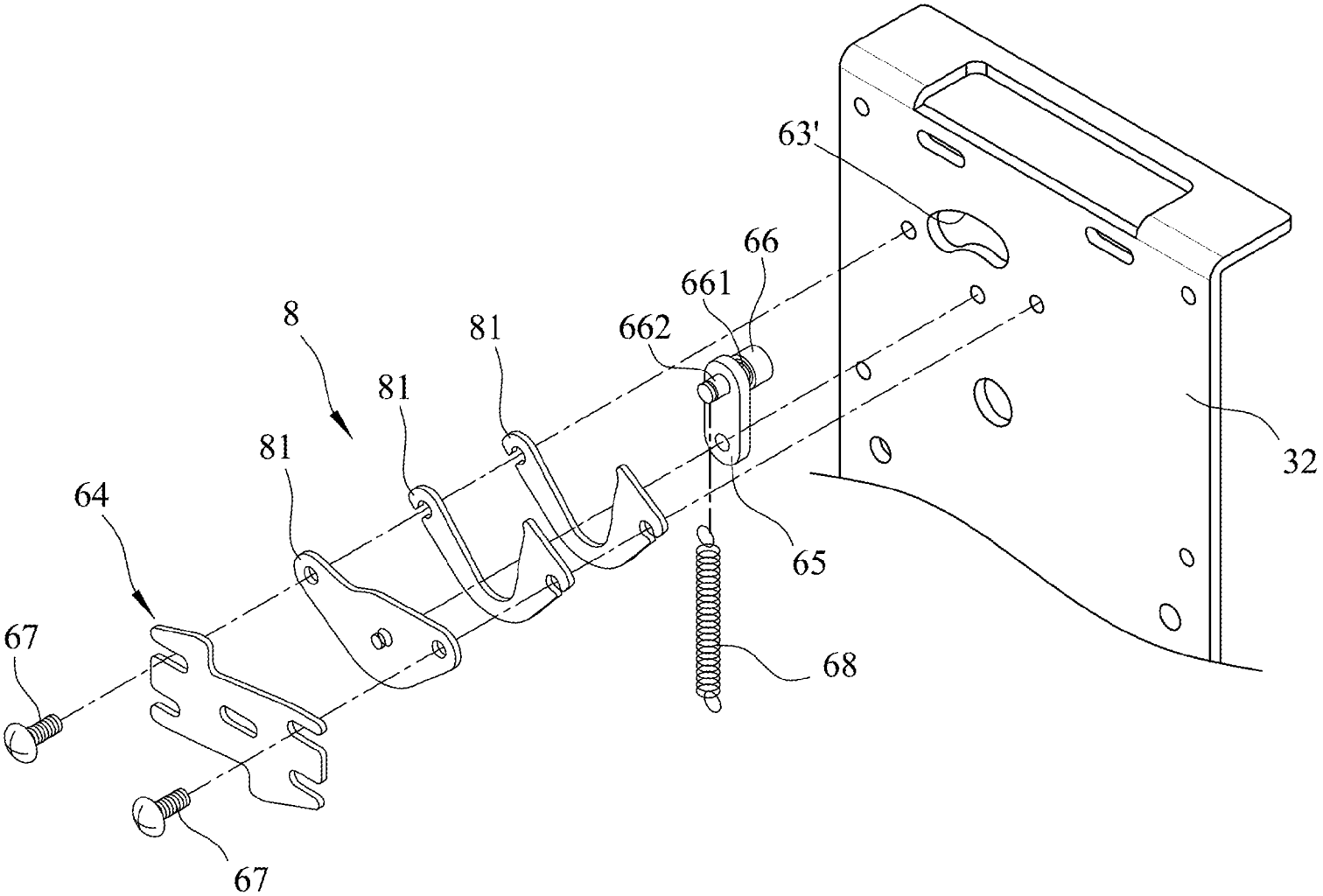
FIG. 5 is a fragmentary exploded perspective view of a base plate, a guiding unit and a washer unit of the embodiment.

Referring to FIGS. 3 to 5, the embodiment of a coin counting apparatus according to the disclosure includes a mounting unit 3, a rotating unit 4, a receiving unit 5, a guiding unit 6, a track unit 7 and a washer unit 8.

The mounting unit 3 includes a mounting seat 31 and a base plate 32. The base plate 32 is connected to the mounting seat 31, and is formed with a base sliding groove 63' (see FIG. 5) extending therethrough.

The rotating unit 4 includes a turntable member 41 and a motor 42. The turntable member 41 is rotatably connected to the base plate 32. The motor 42 is for driving rotation of the turntable member 41. Particularly, the turntable member 41 has a turntable body 411, a plurality of coin holes 412 and a plurality of limiting segment units 413. The turntable body 411 is spaced apart from the base plate 32 and cooperates with the base plate 32 to define an internal coin space therebetween. The coin holes 412 extend through the turntable body 411 and are in spatial communication with the internal coin space. The limiting segment units 413 extend from the turntable body 411 into the internal coin space toward the base plate 32. Each of the limiting segment units 413 is disposed between a respective adjacent pair of the coin holes 412. In this embodiment, each of the limiting segment units 413 includes two curved limiting projections.

The receiving unit 5 is coupled to the base plate 32, surrounds the turntable member 41, and defines a receiving space 51 that is in spatial communication with the coin holes 412 and the internal coin space of the rotating unit 4 and that is adapted for receiving a plurality of coins.

The guiding unit 6 includes three spaced-apart pushing bolts 69, a guiding member 61, a cover member 62, an adjusting plate 64, a swing arm 65, a positioning bolt 66, a resilient member 68 and two fastener members 67.

The pushing bolts 69 extend from the base plate 32 into the internal coin space toward the turntable body 411.

The guiding member 61 is rotatably connected to the base plate 32, and is spaced apart from and configured to be co-rotatable with the turntable member 41. In this embodiment, the guiding member 61 has a rotatable main body 611, and a plurality of angularly spaced-apart guiding arms 612 extending from the rotatable main body 611.

The cover member 62 covers the base plate 32 in proximity to the guiding member 61, cooperates with the base plate 32 to define a guiding space 600, and is formed with a guidance sliding groove 63 extending therethrough. The guidance sliding groove 63 is registered with the base sliding groove 63' of the base plate 32. Particularly, the cover member 62 has a boundary section 621 and a cover section 622. The boundary section 621 is mounted on the base plate 32 and is spaced apart from the guiding member 61. The cover section 622 covers the boundary section 621 and a part of the guiding arms 612, and cooperates with the boundary section 621 and the base plate 32 to define the guiding space 600.

Figure 6:
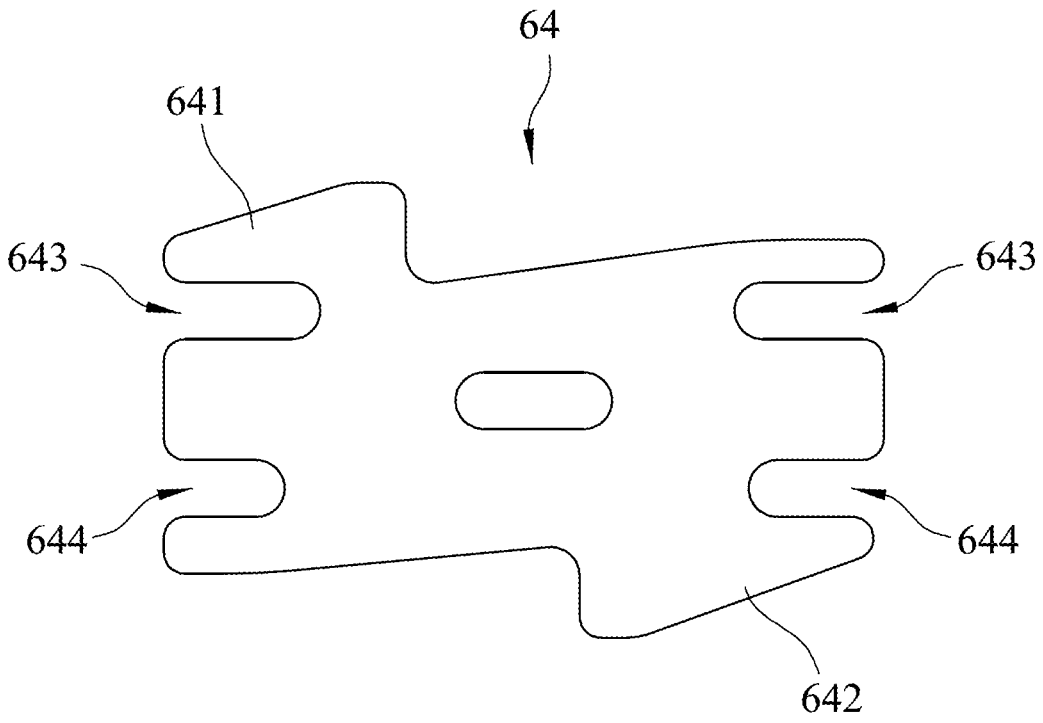
FIG. 6 is a front view of an adjusting plate of the guiding unit.

The adjusting plate 64 is connected to a side of the base plate 32 opposite to the cover member 62, and is movable relative to the base plate 32 and the cover member 62 to adjustably cover a portion of the base sliding groove 63' of the base plate 32. With further reference to FIG. 6, the adjusting plate 64 has two opposite longitudinal sides, two opposite transverse sides, first and second stopper portions 641, 642, two opposite first adjusting notches 643 and two opposite second adjusting notches 644. The longitudinal sides extend in a longitudinal direction. The opposite transverse sides interconnect the opposite longitudinal sides and extend in a transverse direction transverse to the longitudinal direction. The first and second stopper portions 641, 642 respectively project from the longitudinal sides and are diagonally opposite to each other. The opposite first adjusting notches 643 are respectively indented from the transverse sides toward each other. The opposite second adjusting notches 644 are respectively indented from the transverse sides toward each other, and are spaced apart from the first adjusting notches 643. The first adjusting notches 643 have a length in the longitudinal direction that is different from that of the second adjusting notches 644. In this embodiment, a length of the second stopper portion 642 in the longitudinal direction is greater than that of the first stopper portion 641.

As shown in FIGS. 3 and 5, the swing arm 65 is swingably disposed between the base plate 32 and the adjusting plate 64.

The positioning bolt 66 has opposite first and second end portions 661, 662. The first end portion 661 extends from the swing arm 65 and extends slidably into the base sliding groove 63' and the guidance sliding groove 63. The second end portion 662 extends from the swing arm 65 and is close to the adjusting plate 64.

The resilient member 68 is disposed in proximity to the base plate 32 and has two opposite ends respectively connected to the second end portion 662 of the positioning bolt 66 and the base plate 32. As a non-limiting example, the resilient member 68 is an extension spring.

The fastener members 67 extend respectively through the first adjusting notches 643, or alternatively through the second adjusting notches 644 when the adjusting plate 64 is turned upside down from the orientation shown in FIG. 5, to fasten removably the adjusting plate 64 to the base plate 32.

Referring back to FIGS. 3 and 4, the track unit 7 is connected to the guiding unit 6, and includes a track member 71 and a counter 72. The track member 71 defines a passageway 710 in communication with the guiding space 600. The counter 72 is mounted on the track member 71.

As shown in FIG. 5, the washer unit 8 is disposed between the base plate 32 and the adjusting plate 64, and cooperates with the base plate 32 and the adjusting plate 64 to define a space to permit swinging movement of the swing arm 65 therein. Particularly, the washer unit 8 has three washers 81 that are stacked on one another between the base plate 32 and the adjusting plate 64. In this embodiment, the swing arm 65 is pivotally connected to the washers 81. It should be noted that the configuration of the washer unit 8 is not limited to this disclosure.

Figure 7:
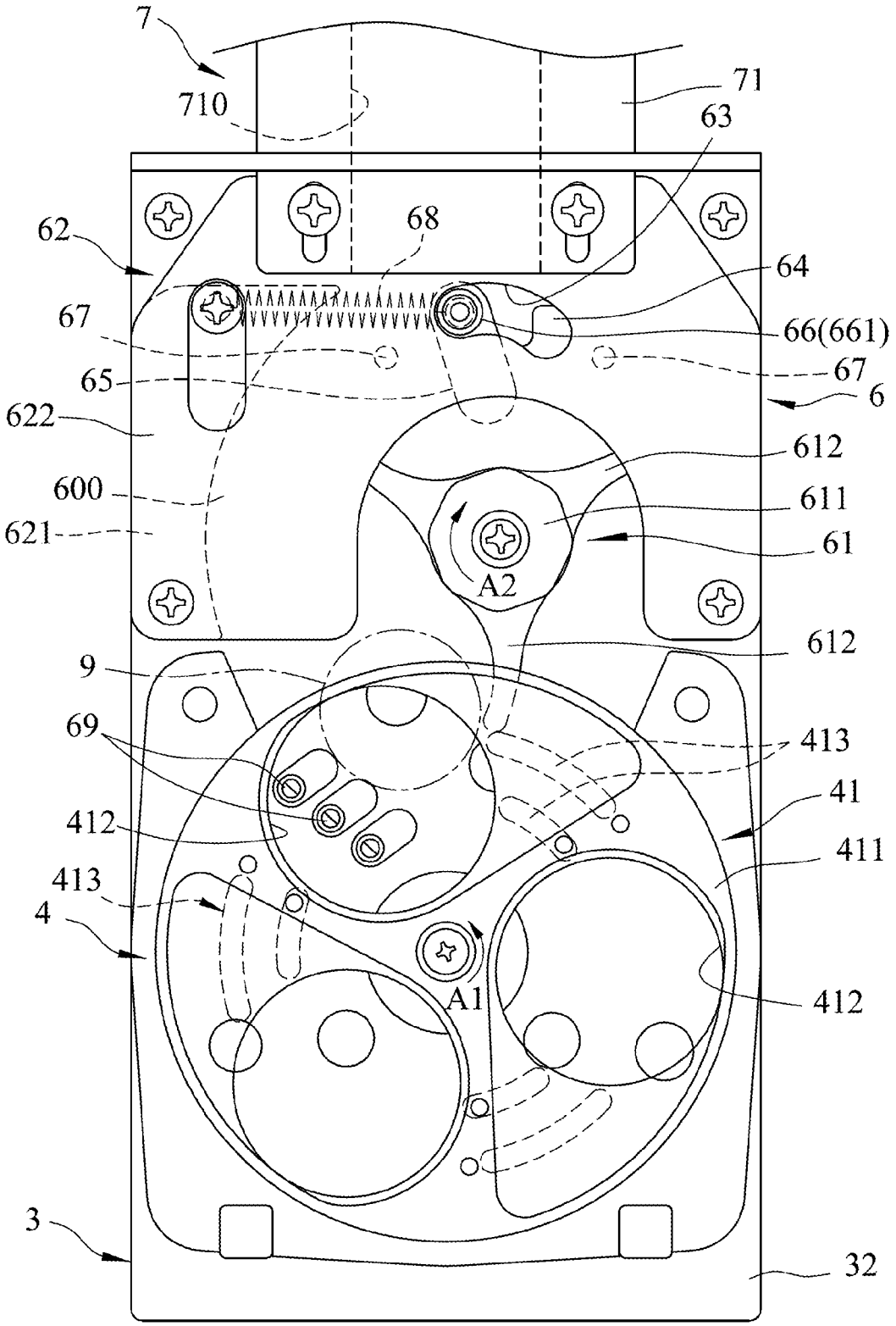
FIGS. 7 to 9 are fragmentary top views illustrating how a coin is conveyed to a passageway through a guiding space.
Figure 8:
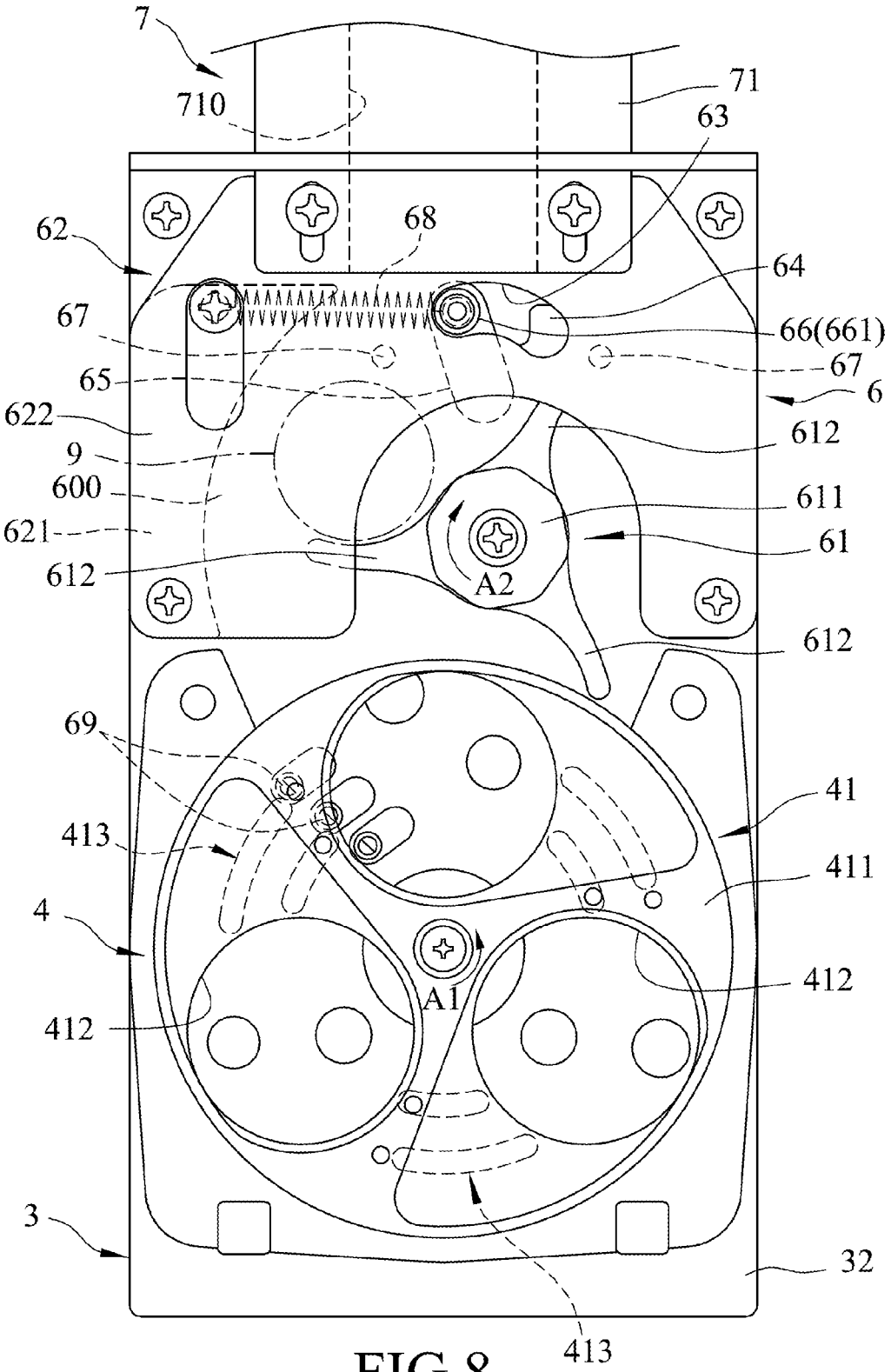

Referring to FIGS. 3, 7 and 8, when the turntable member 41 rotates in a rotational direction (A1) and the guiding member 61 rotates in another rotational direction (A2) opposite the rotational direction (A1) of the turntable member 41, each coin 9 advanced into the internal coin space from the receiving space 51 of the receiving unit 5 via one of the coin holes 412 is moved to be disposed between the pushing bolts 69 and one of the limiting segment units 413, is pushed by the one of the limiting segment units 413 under guidance of the pushing bolts 69 to the guiding member 61, and is brought by one of the guiding arms 612 into the guiding space 600.

Figure 9:
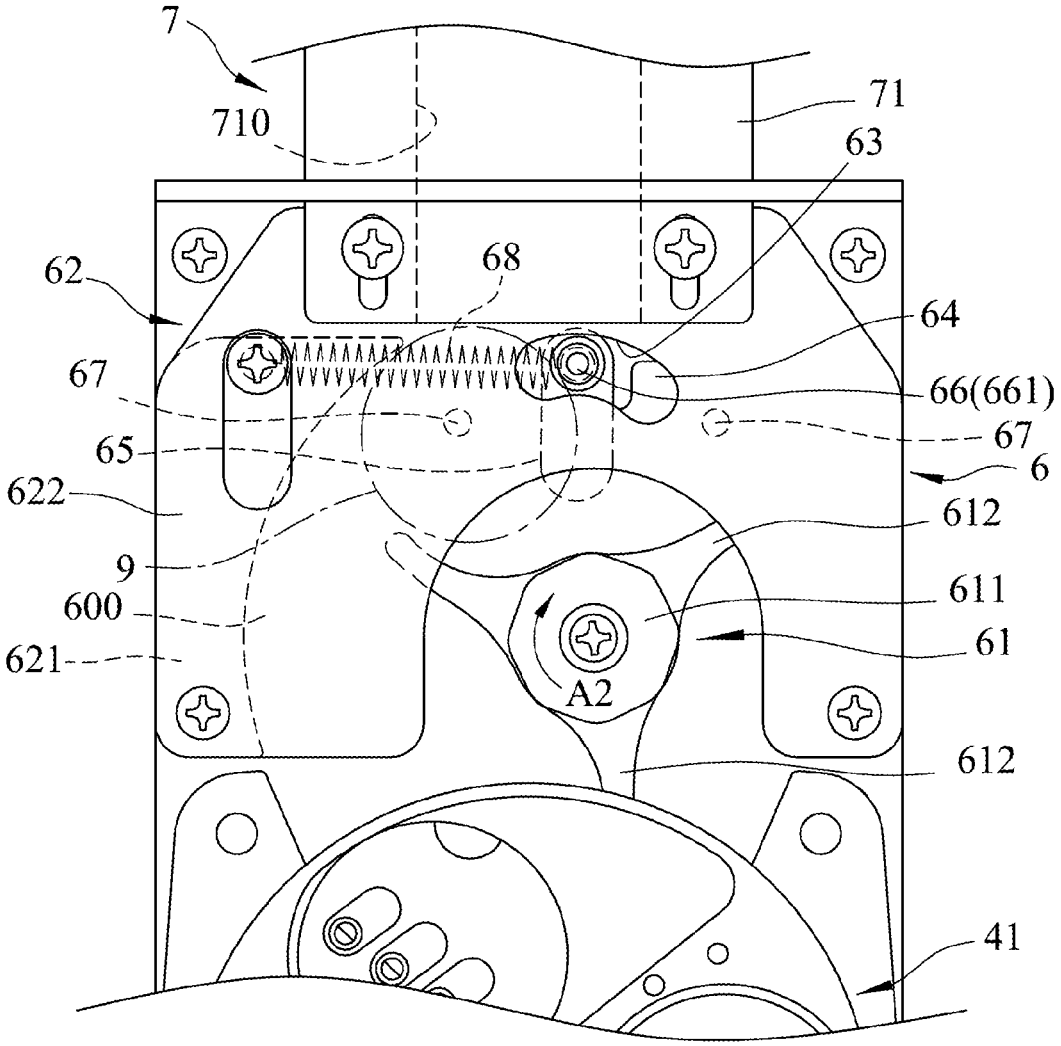

Referring to FIG. 9, during rotation of the guiding member 61, the coin 9 is pushed via the rotation of the guiding member 61 from the rotating unit 4 into the guiding space 600, and is further pushed by the guiding arms 612 to drive pivot movement of the swing arm 65 relative to the base plate 32 (see FIG. 8) and sliding movement of the first end portion 661 of the positioning bolt 66 along the base sliding groove 63' (see FIG. 5) and the guidance sliding groove 63, and to extend resiliently the resilient member 68 until the second end portion 662 (see FIG. 5) of the positioning bolt 66 abuts against the adjusting plate 64, thereby permitting passage of the coin 9 into the passageway 710 as urged by a restoring force of the resilient member 68.

Figure 10:
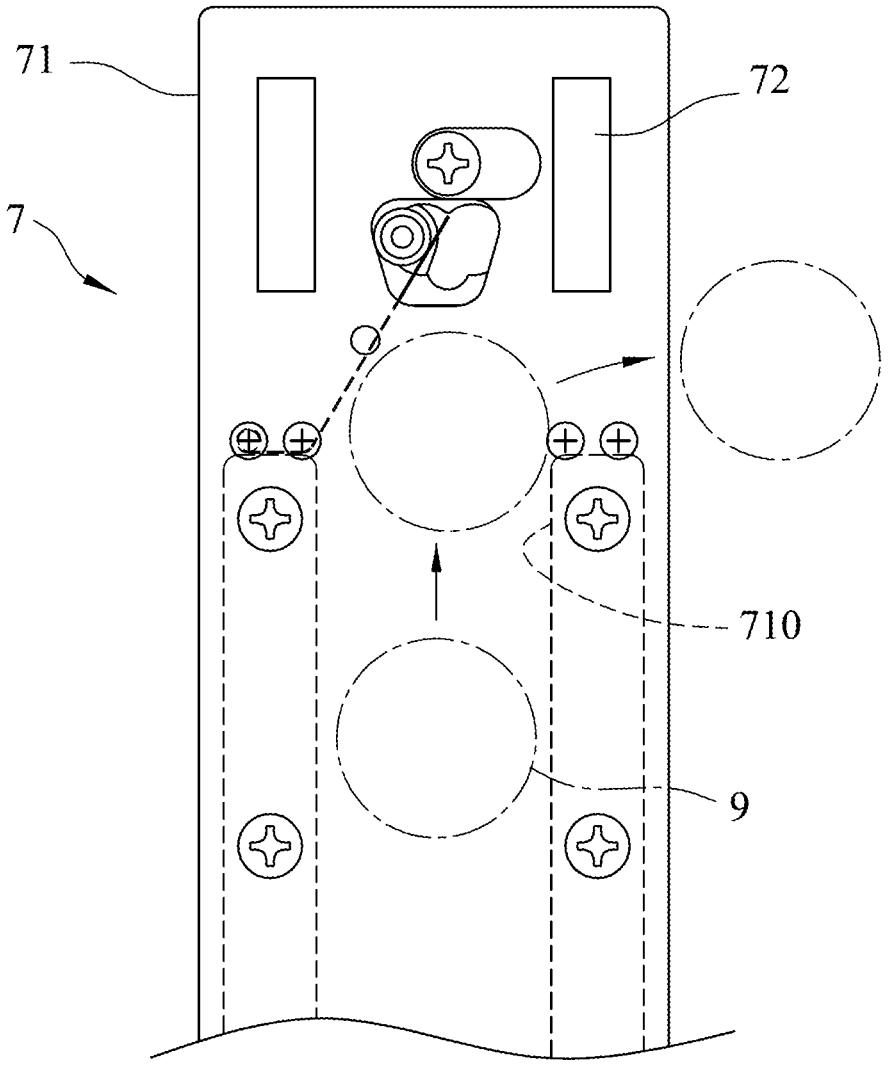
FIG. 10 is a fragmentary schematic view of the embodiment illustrating the coin moving out of a passageway to be counted by a counter.

Afterward, referring to FIG. 10, the coin 9 moves along the passageway 710 and is finally counted by the counter 72. In this embodiment, the counter 72 is a photo interrupter. When the coin 9 moves past a selected location within the passageway 710, light emitted from the counter 72 is interrupted by the coin 9, thereby detecting and counting the coin 9.

Referring back to FIGS. 5 and 6, when the fastener members 67 respectively extend through the first adjusting notches 643 to fasten the adjusting plate 64 to the base plate 32, the first stopper portion 641 covers a portion of the base sliding groove 63' to limit movement of the first end portion 661 of the positioning bolt 66 along the base sliding groove 63' and the guidance sliding groove 63. When the fastener members 67 respectively extend through the second adjusting notches 644 to fasten the adjusting plate 64 to the base plate 32, the second stopper portion 642 covers a portion of the base sliding groove 63' to limit movement of the first end portion 661 of the positioning bolt 66 along the base sliding groove 63' and the guidance sliding groove 63.

Figure 11:
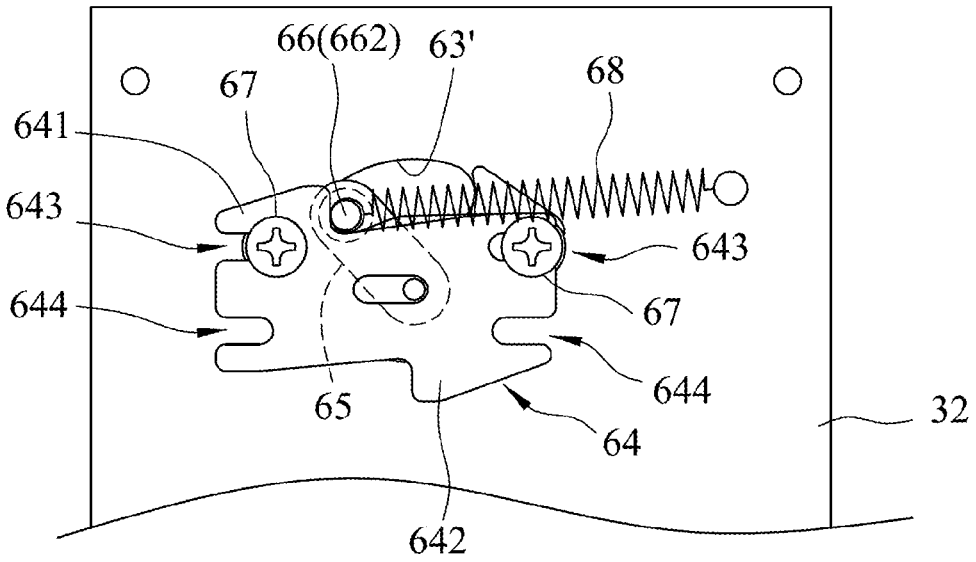
FIGS. 11 and 12 are rear views illustrating adjustment of the position of the adjusting plate.
Figure 12:
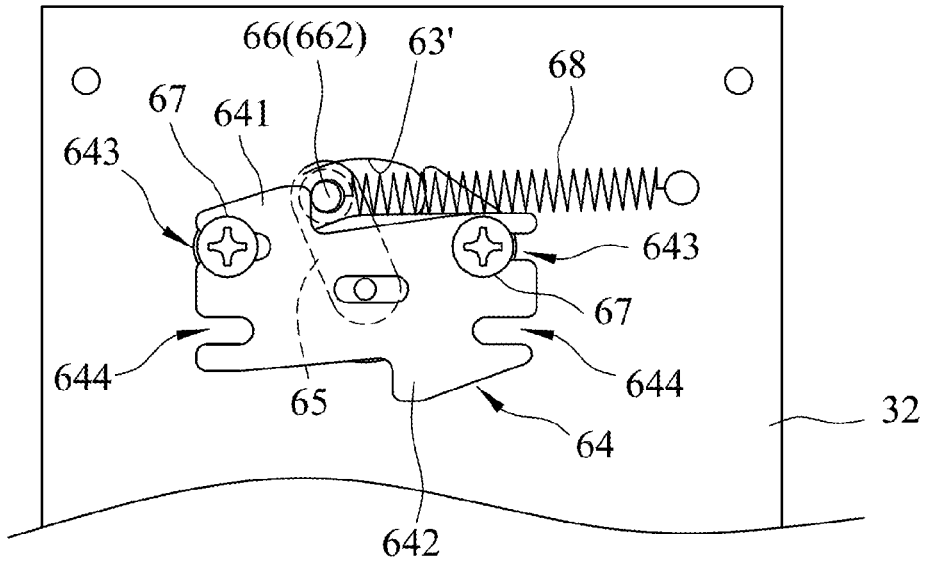
Figure 13:
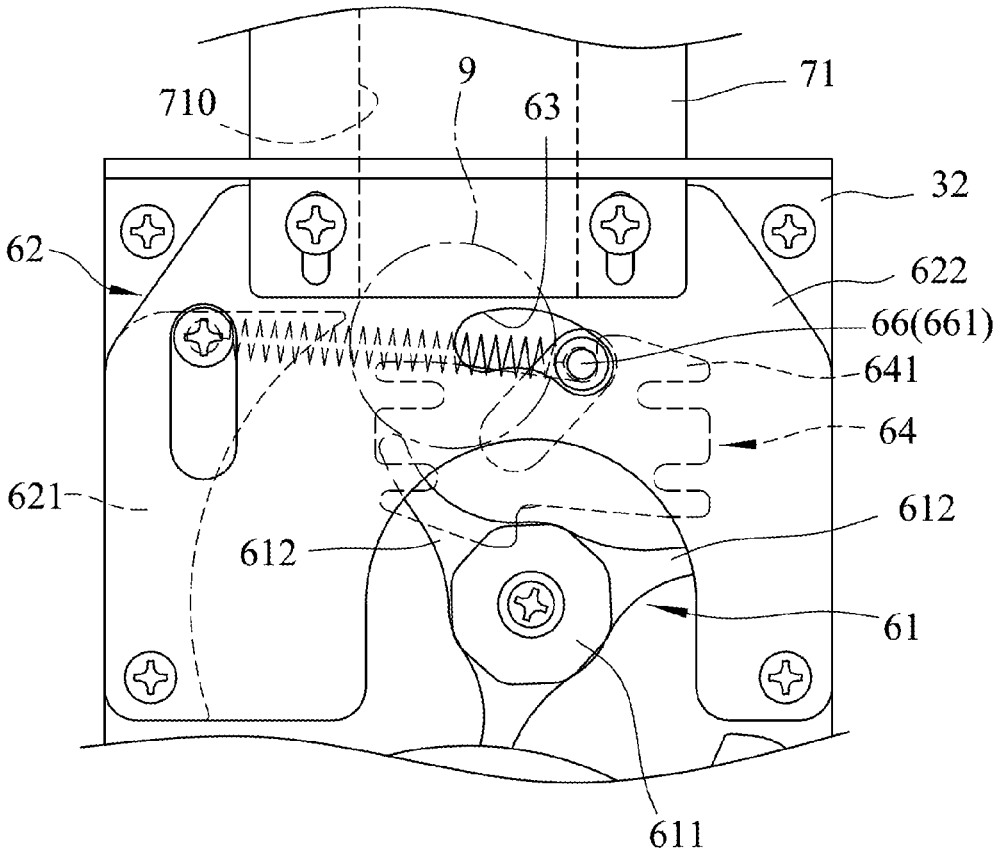
FIGS. 13 and 14 are front views illustrating the adjustment of the position of the adjusting plate.
Figure 14:
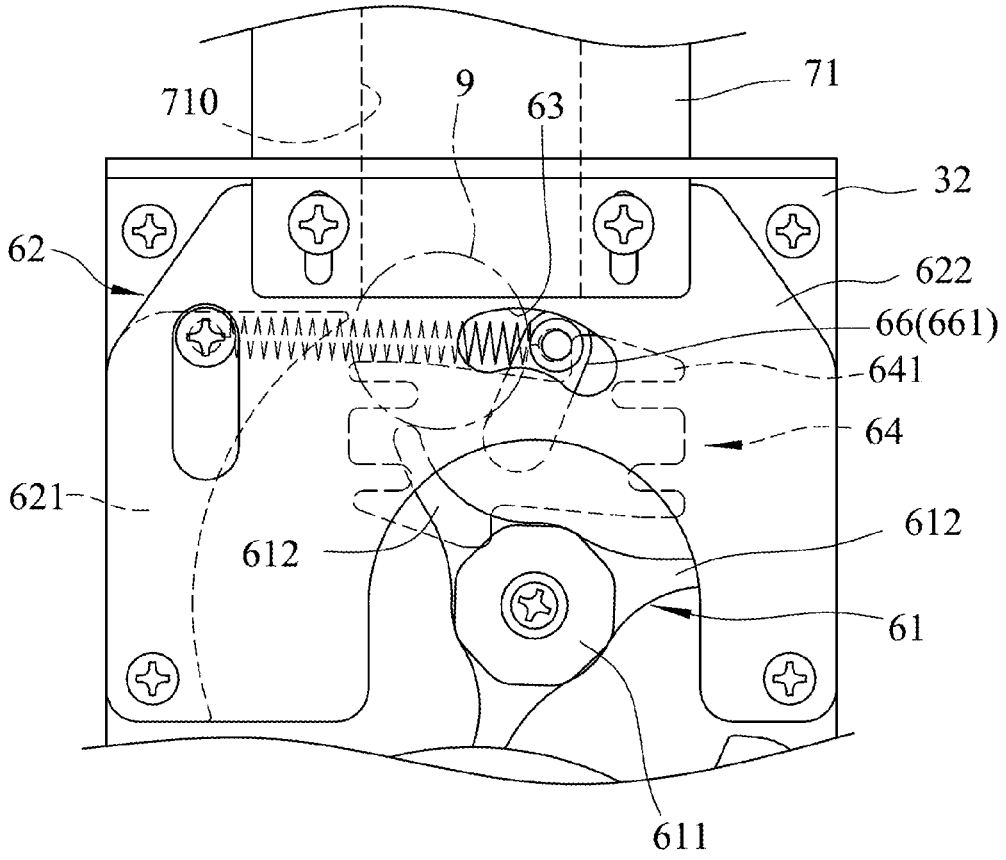

Referring to FIGS. 11 and 12, in order to correspond to the diameter of the coins 9 (see FIG. 10), the adjusting plate 64 can be moved in the longitudinal direction to change the portion of the base sliding groove 63' covered by the first stopper portion 641, thereby adjusting the range of movement of the first end portion 661 (see FIG. 5) of the positioning bolt 66 along the base sliding groove 63' and the guidance sliding groove 63 (see FIG. 4) (FIGS. 13 and 14 are front views respectively illustrating the ranges of movement of the first end portion 661 of the positioning bolt 66 along the guidance sliding groove 63 respectively corresponding to the positions of the adjusting plate 64 shown in FIGS. 11 and 12). For example, when the coins 9 have a smaller diameter, by moving the adjusting plate 64 in the longitudinal direction to cover a larger portion of the base sliding groove 63' (see FIG. 12), the range of movement of the first end portion 661 of the positioning bolt 66 along the base sliding groove 63' and the guidance sliding groove 63 is shortened (see FIG. 14).

Figure 15:
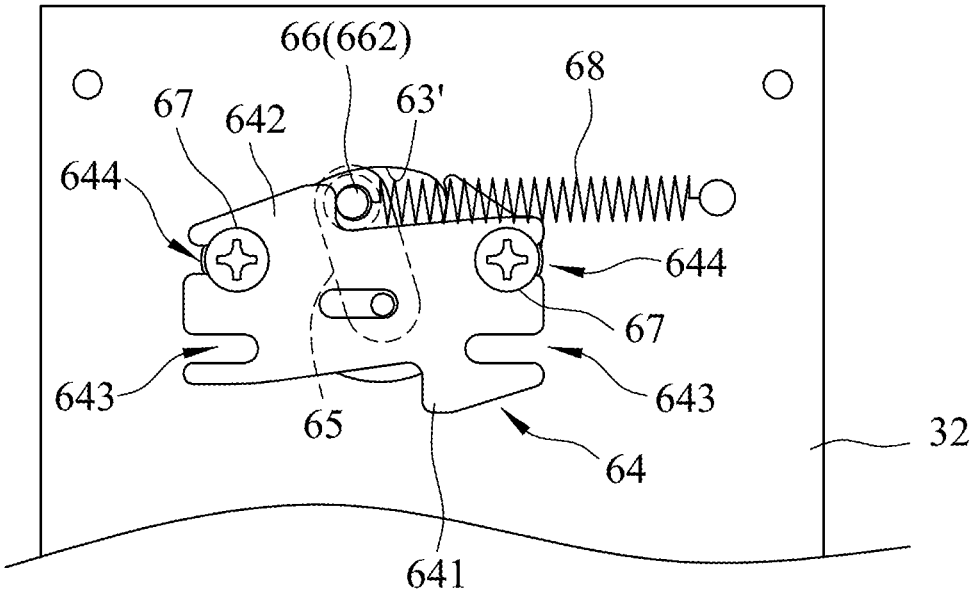
FIG. 15 is a view similar to FIG. 11, but illustrating the adjusting plate being turned upside down.

Referring further to FIG. 15, the adjusting plate 64 may be released, turned or flipped upside down, and refastened to the base plate 32 with the fastener members 67 respectively extending through the second adjusting notches 644. Since the length of the second stopper portion 642 in the longitudinal direction is greater than that of the first stopper portion 641, a comparison between FIGS. 12 and 15 reveals that a range of movement of the first end portion 661 of the positioning bolt 66 along the base sliding groove 63' and the guidance sliding groove 63 when the fastener members 67 respectively extend through the first adjusting notches 643 to fasten the adjusting plate 64 to the base plate 32 is greater than that when the fastener members 67 respectively extend through the second adjusting notches 644 to fasten the adjusting plate 64 to the base plate 32. Therefore, such an arrangement of the adjusting plate 64 gives the coin counting apparatus a relatively large flexibility for when the size of the coins 9 is even smaller. Likewise, location of the adjusting plate 64 fastened to the base plate 32 can be adjusted in the longitudinal direction when the fastener members 67 respectively extend through the second adjusting notches 644.

To sum up, by virtue of covering a portion of the base sliding groove 63' with a selected one of the first and second stopper portions 641, 642 as well as moving the adjusting plate 64 in the longitudinal direction, the range of movement of the first end portion 661 of the positioning bolt 66 along the base sliding groove 63' and the guidance sliding groove 63 can vary to correspond to coins 9 of different diameters. As such, each of the coins 9 in the guiding space 600 can successfully press the first end portion 661 of the positioning bolt 66 to drive the second end portion 662 of the positioning bolt 66 to abut against the selected one of the first and second stopper portion 641, 642, and the restoring force of the resilient member 68 can effectively force each of the coins 9 into the passageway 710 to be subsequently counted by the counter 72.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A coin counting apparatus comprising:

a mounting unit including a mounting seat, and a base plate that is connected to said mounting seat, and that is formed with a base sliding groove extending therethrough;

a rotating unit including a turntable member that is rotatably connected to said base plate, and a motor that is for driving rotation of said turntable member;

a receiving unit coupled to said base plate, surrounding said turntable member, and defining a receiving space that is adapted for receiving a plurality of coins;

a guiding unit including a guiding member that is rotatably connected to said base plate, and that is spaced apart from and configured to be co-rotatable with said turntable member, a cover member that covers said base plate in proximity to said guiding member, that cooperates with said base plate to define a guiding space, and that is formed with a guidance sliding groove extending therethrough, said guidance sliding groove being registered with said base sliding groove of said base plate, an adjusting plate that is connected to a side of said base plate opposite to said cover member, and that is movable relative to said base plate and said cover member to adjustably cover a portion of said base sliding groove, a swing arm that is swingably disposed between said base plate and said adjusting plate, a positioning bolt that has opposite first and second end portions, said first end portion extending from said swing arm and extending slidably into said base sliding groove and said guidance sliding groove, said second end portion extending from said swing arm and being close to said adjusting plate, two fastener members that fasten removably said adjusting plate to said base plate, and a resilient member that is disposed in proximity to said base plate and that has two opposite ends respectively connected to said second end portion of said positioning bolt and said base plate; and a track unit connected to said guiding unit and including a track member that defines a passageway in communication with said guiding space, and a counter that is mounted on said track member;

wherein each of the coins is pushed via rotation of said guiding member from said rotating unit into said guiding space, and is further pushed by said guiding member to drive sliding movement of said first end portion of said positioning bolt along said base sliding groove and said guidance sliding groove, and to extend resiliently said resilient member until said second end portion of said positioning bolt abuts against said adjusting plate, thereby permitting passage of the coin into said passageway;

wherein said adjusting plate has two opposite longitudinal sides that extend in a longitudinal direction, two opposite transverse sides that interconnect said opposite longitudinal sides and that extend in a transverse direction transverse to the longitudinal direction, first and second stopper portions that respectively project from said longitudinal sides and that are diagonally opposite to each other, two opposite first adjusting notches that are respectively indented from said transverse sides toward each other, and two opposite second adjusting notches that are respectively indented from said transverse sides toward each other, and that are spaced apart from said first adjusting notches;

wherein, when said fastener members respectively extend through said first adjusting notches to fasten said adjusting plate to said base plate, said first stopper portion covers a portion of said base sliding groove to limit movement of said first end portion of said positioning bolt along said base sliding groove and said guidance sliding groove; and wherein, when said fastener members respectively extend through said second adjusting notches to fasten said adjusting plate to said base plate, said second stopper portion covers a portion of said base sliding groove to limit movement of said first end portion of said positioning bolt along said base sliding groove and said guidance sliding groove.

2. The coin counting apparatus as claimed in claim 1, wherein said first adjusting notches have a length in the longitudinal direction that is different from that of said second adjusting notches.

3. The coin counting apparatus as claimed in claim 1, wherein:

a length of said second stopper portion in the longitudinal direction is greater than that of said first stopper portion; and a range of movement of said first end portion of said positioning bolt along said base sliding groove and said guidance sliding groove when said fastener members respectively extend through said first adjusting notches to fasten said adjusting plate to said base plate is greater than that when said fastener members respectively extend through said second adjusting notches to fasten said adjusting plate to said base plate.

4. The coin counting apparatus as claimed in claim 1, wherein said turntable member has:

a turntable body spaced apart from said base plate and cooperating with said base plate to define an internal coin space therebetween;

a plurality of coin holes that extend through said turntable body; and a plurality of limiting segment units that extend from said turntable body into said internal coin space toward said base plate, each of said limiting segment units being disposed between a respective adjacent pair of said coin holes.

5. The coin counting apparatus as claimed in claim 4, wherein:

said guiding unit further includes a plurality of pushing bolts that extend from said base plate into said internal coin space toward said turntable body;

said guiding member has a rotatable main body, and a plurality of guiding arms extending from said rotatable main body; and each coin advanced into said internal coin space from said receiving unit via one of said coin holes is disposed between said pushing bolts and one of said limiting segment units, is pushed by the one of said limiting segment units under guidance of said pushing bolts to said guiding member, and is brought by said guiding member into said guiding space.

6. The coin counting apparatus as claimed in claim 5, wherein:

said cover member has a boundary section that is mounted on said base plate and that is spaced apart from said guiding member; and a cover section that covers said boundary section and a part of said guiding arms, and that cooperates with said boundary section and said base plate to define said guiding space.

7. The coin counting apparatus as claimed in claim 1, further comprising a washer unit that is disposed between said base plate and said adjusting plate, and that cooperates with said base plate and said adjusting plate to define a space to permit swing movement of said swing arm therein, said swing arm being pivotally connected to said washer unit.

8. The coin counting apparatus as claimed in claim 1, wherein said resilient member is an extension spring.

9. The coin counting apparatus as claimed in claim 1, wherein said counter is a photo interrupter.

* * * * *